US007617547B2

(12) United States Patent
Peterson et al.

(10) Patent No.: US 7,617,547 B2
(45) Date of Patent: Nov. 17, 2009

(54) REPAIR KIT FOR INFLATABLE POOLS

(76) Inventors: Douglas J. Peterson, 851 Brill Dr., Bullhead City, AZ (US) 86442; Vicki Earline Peterson, 851 Brill Dr., Bullhead City, AZ (US) 86442

( * ) Notice: Subject to any disclaimer, the term of this patent is extended or adjusted under 35 U.S.C. 154(b) by 810 days.

(21) Appl. No.: 11/206,566

(22) Filed: Aug. 18, 2005

(65) Prior Publication Data

US 2007/0039094 A1 Feb. 22, 2007

(51) Int. Cl.
*F04D 35/00* (2006.01)

(52) U.S. Cl. ..... 4/506

(58) Field of Classification Search ..... 4/506, 4/513, 585

See application file for complete search history.

(56) References Cited

U.S. PATENT DOCUMENTS 2,529,872 A * 11/1950 Hasselquist ..... 4/506
3,512,186 A 5/1970 Sanford
4,124,049 A * 11/1978 Yamaguchi ..... 220/216
4,853,984 A 8/1989 Celiano
5,546,972 A 8/1996 Wardell et al.

* cited by examiner

*Primary Examiner*—Huyen Le
(74) *Attorney, Agent, or Firm*—Raymond M. Galasso; Galasso & Associates, LP

(57) ABSTRACT

A repair kit is provided for extending the use of inflatable pools. When the inflatable ring around the top of such a pool is deflated, flotation devices are placed under the flap of the inflatable ring. Any flotation devices may be used that are safe, provide buoyancy, and will not puncture the material of the ring, for example the foam flotation devices called "noodles." The flotation devices are kept in place under the flap of the ring by a binding apparatus with sufficient weight to keep the flotation devices from floating loose. For example, a standard garden hose may be inserted through a small slit in the ring to serve as binding. The repair kit may be used on a pool with a ring without a leak, to avoid having subsequent leaks. The repair kit also allows a pool to be filled higher with water than when the pool's ring is inflated.

12 Claims, 3 Drawing Sheets

REPAIR KIT FOR INFLATABLE POOLS

FIELD OF THE DISCLOSURE

The present invention relates to inflatable swimming pools and more particularly to a repair kit for extending the life and use of inflatable swimming pools.

BACKGROUND

Millions of people enjoy swimming in above-ground inflatable swimming pools. Many of these pools have an inflatable ring around the top of the pool, which floats upward when water is added to the pool. This action raises the walls of the pool so that water may be retained within the pool. Leaks in an inflatable ring, for example from punctures by dogs, cats, or the teeth of small children, may occur frequently and can cause the walls of a pool to collapse, so that water pours out of the pool.

Inflatable rings for pools are typically repaired with adhesive patches, but these sometimes do not hold and fail to prevent other leaks. After each patch, the inflatable pool must be inflated again by pumping in air, which can be time-consuming and laborious. Moreover, major tears in inflatable rings are difficult to repair with adhesive patches. In addition, the material of inflatable rings may wear out faster over time that the more durable materials used for the sides and bottoms of these pools, so that patching becomes impractical. In such cases currently the entire pools must be replaced, which can be expensive.

Therefore, there is a need for a simple, inexpensive, and effective means of repairing the inflatable rings of above-ground swimming pools to extend the life and use of those pools.

SUMMARY OF THE DISCLOSURE

The following explanation describes the present invention by way of example and not by way of limitation.

It is an aspect of the present invention to provide a simple, inexpensive, and effective means of repairing the inflatable rings of above-ground swimming pools.

It is another aspect of the present invention to use readily available materials to provide a simple, inexpensive, and effective means of repairing the inflatable rings of above-ground swimming pools.

It is still another aspect of the present invention to provide a means of extending the life and use of above-ground swimming pools through at least one flotation device and at least one binding apparatus.

It is yet another aspect of the present invention to provide a means of filling above-ground swimming pools higher with water by using at least one flotation device and at least one binding apparatus than is possible when the inflation rings on the pools are inflated.

These and other aspects of the present invention will become readily apparent upon further review of the following specification and associated drawings. In accordance with the present invention, a repair kit is provided for extending the use of inflatable pools. When the inflatable ring around the top of such a pool is deflated, flotation devices are placed under the flap of the inflatable ring. Any flotation devices may be used that are safe, provide buoyancy, and will not puncture the material of the ring, for example the foam flotation devices called "noodles." The flotation devices are kept in place under the flap of the ring by a binding apparatus with sufficient weight to keep the flotation devices from floating loose. For example, a standard garden hose may be inserted through a small slit in the ring to serve as binding. The repair kit may be used on a pool with a ring without a leak, to avoid having subsequent leaks. The repair kit also allows a pool to be filled higher with water than when the pool's ring is inflated.

BRIEF DESCRIPTION OF THE DRAWINGS

The following embodiments of the present invention are described by way of example only, with reference to the accompanying drawings, in which.

DETAILED DESCRIPTION OF THE DRAWING FIGURES

The following description of drawings is offered to illustrate the present invention clearly. However, it will be apparent to those skilled in the art that the concepts of the present invention are not limited to these specific details. Also, commonly known elements are shown in diagrams for clarity, as examples only and not as limitations of the present invention.

Figure 1:
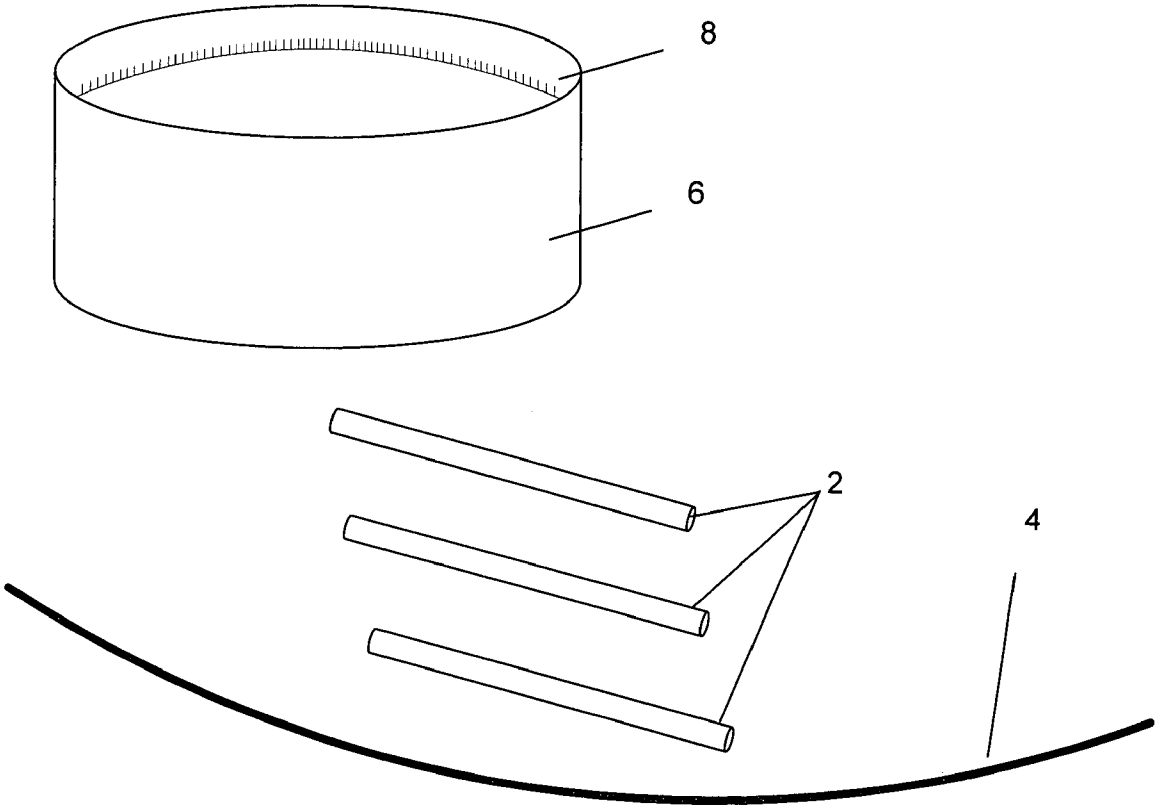
FIG. 1 is a block diagram that illustrates the components of a repair kit for inflatable swimming pools.

The present invention comprises a repair kit for inflatable pools. As shown in FIG. 1, the repair kit comprises the following elements:

At least one flotation device 2, and

At least one binding apparatus 4.

At least one flotation device 2 serves to float the inflatable ring 8 around the top rim of an inflatable pool 6. In an embodiment, multiple flotation devices 2 may be used. Any flotation devices may be used that are safe, provide buoyancy, and will not puncture the material of the ring. Typically, the flotation devices 2 are oval or circular in shape.

In an embodiment, flotation devices 2 manufactured of foam, comprising aerated plastic, may be used that are non-corrosive, durable, strong, and that accept and retain coloring materials for an extended period of time. For example, the flotation devices commonly called "noodles" and readily available on the market, may be used, either in whole sections of the noodles or in segments. Segments cut from whole sections with a knife or other cutting tool may be used or segments that are broken off. The number of sections and segments to be used would be dependent on the size of the pool 6 to be repaired.

For example, the flotation devices 2 may comprise foam noodles that are typically four inches in diameter and three to five feet in length. In an embodiment approximately ten flotation devices 2 that are four inches in diameter and five feet in length are sufficient for an above-ground inflatable pool 6 that is fifteen feet in diameter.

In another embodiment, a single flotation device 2 may be used that measures in length approximately the circumference of the inflatable ring 8 of a particular pool 6. For a pool 6 with an inflatable ring 8 that is 20 feet in circumference, for example, a flotation device 2 that is 20 feet long may be used.

The binding apparatus 4 is used to bind the flotation device or devices 2 in place and to provide ballast to keep them from floating loose. In an embodiment, a standard rubber garden hose may be used that also is non-corrosive, durable, strong, and that can accept and retain coloring materials for an extended period of time. The length of the garden hose to be used would be dependent on the size of the pool to be repaired. In other embodiments, the garden hose 4 may be replaced by other binding apparatuses that also provide ballast, for example ropes made of various materials.

Use

Figure 2:
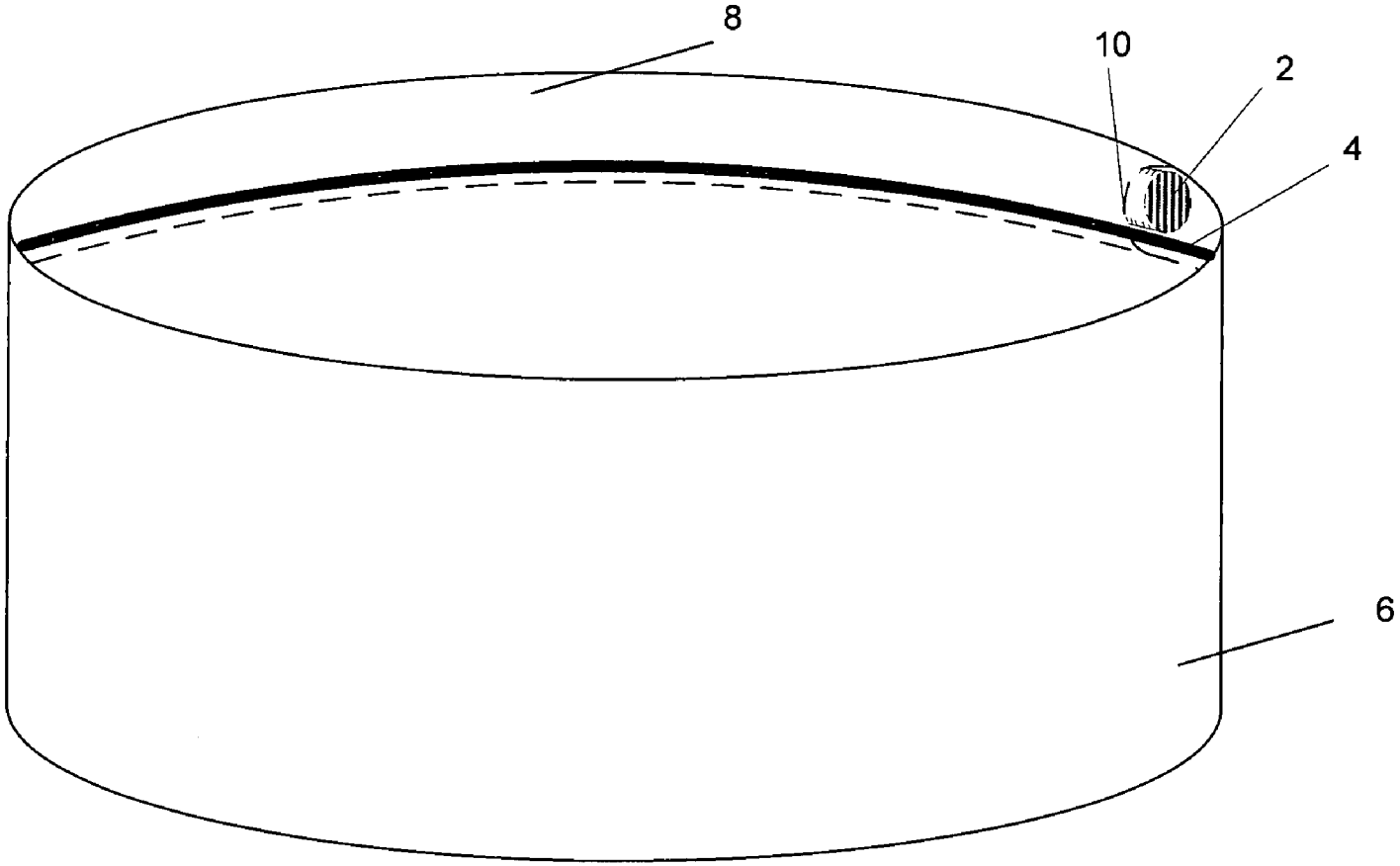
FIG. 2 is a block diagram that illustrates an inflatable swimming pool with a repair kit in place.

The repair kit may be used as follows. When the inflatable ring 8 of a pool 6 is deflated, the user places a sufficient number of flotation devices 2 under the material of the inflatable ring 8, all the way around the pool 6, to float the inflatable ring 8, as shown in FIG. 2. Floating the inflatable ring 8 raises the walls of the pool 6 so that water may be retained inside.

After the flotation devices 2 are in place under the inflatable ring 8, the user cuts a small slit 10 in the inflation ring 8 and threads the binding apparatus 4 through the inflation ring 8 all the way around the pool 6 so that the binding apparatus 4 retains the flotation devices 2 within the material of the inflatable ring 8. For example, the user threads a garden hose 4, or other binding apparatus with sufficient ballast, through the inflatable ring 8. In this way the flotation devices 2 are held in place securely so that they cannot float out of position around the inflatable ring 8, which could cause the walls of the pool 6 to collapse and water to be drained from the pool 6. The garden hose 4 should be of sufficient weight to keep the flotation devices 2 from floating out from underneath the garden hose 4.

Figure 3:
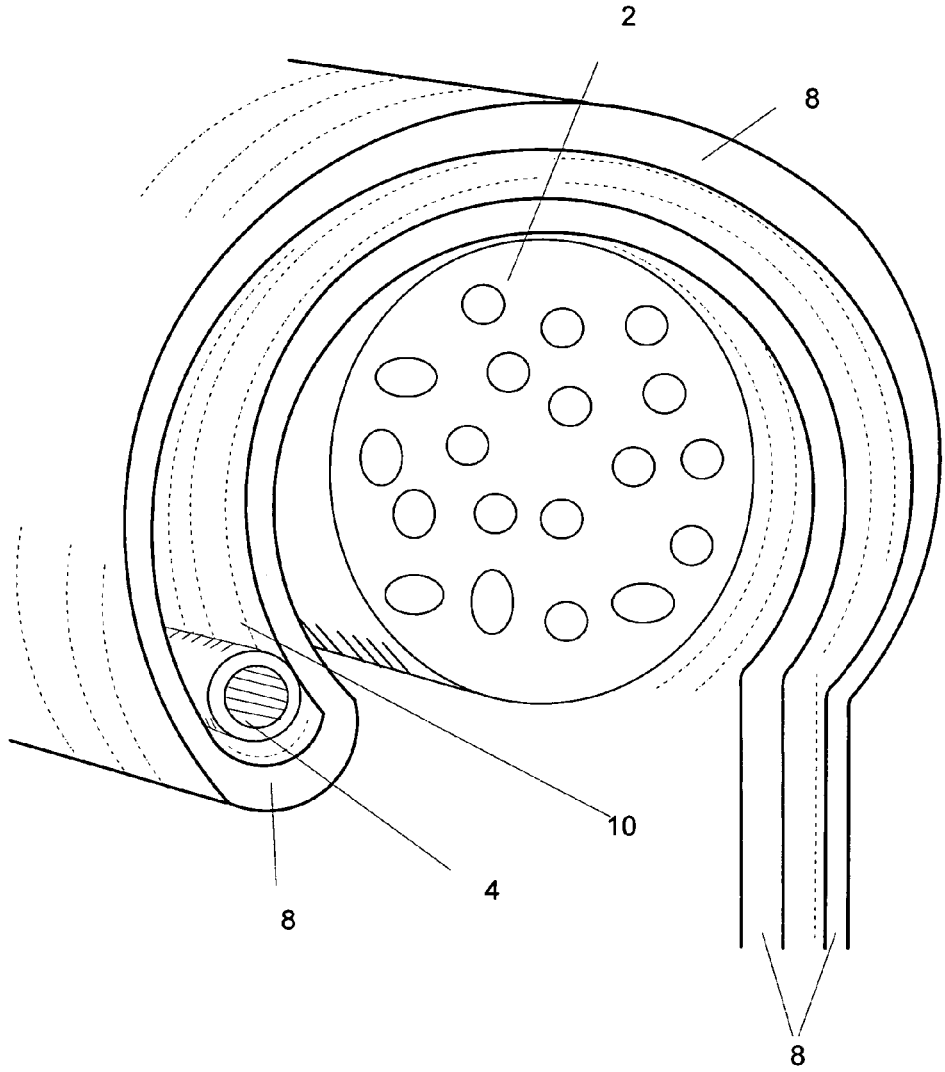
FIG. 3 is a block diagram that illustrates the insertion is a garden hose through a slit in a deflated inflation ring.

FIG. 3 shows a close-up view of a section of a flotation device 2 that has been inserted underneath a deflated inflation ring 8. The slit 10 in the inflation ring 8 allows the user to thread a garden hose 4 through the two layers of the material of the inflation ring 8, so that the garden hose 4 can be placed underneath the flotation device 2 all the way around the pool and so holds the flotation device 2 in position.

An added advantage of the repair kit is that it typically allows an above-ground swimming pool 6 to be filled higher than is possible when the inflatable ring 8 is inflated. This is because the flotation devices 2 that are required to raise the walls of the pool 6 take up less room than the amount of air required to raise those walls. For example, an inflatable pool 6 may be filled four to six inches higher through use of the repair kit.

The user may need to experiment to determine the number of flotation devices 2 necessary to raise the walls of the pool 6 securely and the length of the garden hose 4 required to bind the flotation devices 2 and provide sufficient ballast to hold the flotation devices 2 in place.

In another embodiment, the repair kit may be used on an undamaged pool 6 by not inflating the inflatable ring 8 and proceeding as explained above, with the flotation devices 2 placed under the deflated ring 8. This would prevent the annoyance of having subsequent punctures in the new inflatable ring 8 that would require patching and pumping for re-inflation.

Thus the repair kit can be used on a collapsed pool 6 or on an undamaged pool 6 to extend the life and use of the pool 6 by years.

The best dimensional relationships for the parts of the invention described above, including variations in form and use, will be readily apparent to those skilled in the art, and are intended to be encompassed by the present invention.

What is claimed is:

1. A repair kit for floating the inflatable ring on an above-ground inflatable swimming pool such that the swimming pool can contain water, the repair kit comprising at least one flotation device, said at least one flotation device capable of fitting around the inner periphery of the inflatable pool, and wherein an inflatable ring extends over said at least one flotation device; and at least one binding apparatus capable of binding each flotation device in place about the inflatable ring, said binding apparatus providing sufficient weight to keep each flotation device from floating out from under the binding apparatus.

2. The flotation device of claim 1, wherein the flotation device is circular in shape.

3. The flotation device of claim 1, wherein the flotation device comprises a plurality of flotation devices.

4. The means of binding of claim 1, wherein the means of binding comprises a garden hose.

5. A repair kit for increasing the water level capacity of an above-ground inflatable swimming pool such that the swimming pool can contain a higher level of water when the inflatable ring on the pool is deflated than when that inflatable ring is inflated, the repair kit comprising at least one flotation device, said at least one flotation device extending around the inner periphery of the above-around inflatable swimming pool;

an inflatable ring in a deflated state; said inflatable ring capable of extending over the at least one flotation device; and at least one binding apparatus capable of binding each flotation device in place about the inflatable ring, said binding apparatus providing sufficient weight to keep each flotation device from floating out from under the binding apparatus.

6. The flotation device of claim 5, wherein the flotation device is circular in shape.

7. The flotation device if claim 5, wherein the flotation device comprises a plurality of flotation devices.

8. The means of binding of claim 5, wherein the means of binding comprises a garden hose.

9. A repair kit for floating an inflatable ring on an above-ground inflatable swimming pool such that the swimming pool can contain water; and increasing the water level capacity of the above-ground inflatable swimming pool such that the swimming pool can contain a higher level of water when the inflatable ring on the pool is deflated than when the inflatable ring is inflated, the repair kit comprising at least one flotation device; said at least one flotation device capable of extending around a portion of the inner periphery of the above-ground inflatable swimming pool;

an inflatable ringand at least one binding apparatus capable of binding each flotation device in place about the inflatable ring, said binding apparatus operable to be inserted into the inflatable ring and provides sufficient weight to keep each flotation device from floating out from under the binding apparatus.

10. The flotation device of claim 9, wherein the flotation device is circular in shape, and four inches in diameter.

11. The flotation device of claim 9, wherein the flotation device comprises a plurality of flotation devices.

12. The means of binding of claim 9, wherein the means of binding comprises a garden hose.

* * * * *